US006011464A

United States Patent [19]

Thuillard

[11] Patent Number: 6,011,464

[45] Date of Patent: Jan. 4, 2000

[54] METHOD FOR ANALYZING THE SIGNALS OF A DANGER ALARM SYSTEM AND DANGER ALARM SYSTEM FOR IMPLEMENTING SAID METHOD

[75] Inventor: Marc Pierre Thuillard, Uetikon am See, Switzerland

[73] Assignee: Cerberus AG, Mannedorf, Switzerland

[21] Appl. No.: 09/077,106

[22] PCT Filed: Sep. 19, 1997

[86] PCT No.: PCT/CH97/00354

§ 371 Date: Sep. 30, 1998

§ 102(e) Date: Sep. 30, 1998

[87] PCT Pub. No.: WO98/15931

PCT Pub. Date: Apr. 16, 1998

[30] Foreign Application Priority Data

Oct. 4, 1996 [EP] European Pat. Off. ..... 96115952

[51] Int. Cl.[7] ..... G08B 29/00

[52] U.S. Cl. ..... 340/506; 340/511; 340/577; 340/578; 340/657; 706/8

[58] Field of Search ..... 340/506, 511, 340/577, 578, 657; 706/1, 3, 8

[56] References Cited

U.S. PATENT DOCUMENTS 4,866,420 9/1989 Meyer, Jr. ..... 340/578
5,594,421 1/1997 Thuillard ..... 340/578
5,793,288 8/1998 Peterson et al. ..... 340/567
5,815,198 9/1998 Vachtsevanos et al. ..... 382/141

FOREIGN PATENT DOCUMENTS 718814 6/1996 European Pat. Off. .
706142 10/1996 European Pat. Off. .

OTHER PUBLICATIONS

Mufti M et al., "Automated Fault Detection and Identification Using a Fuzzy–Wavelet Analysis Technique", Conference Record Autotestcon '95, Atlanta, Aug. 8–10, 1995; vol. 31, Aug. 8, 1995, Institute of Electrical and Electronics Engineers, pp. 169–175, XP000555102, at pp. 170–171, Fig. 3.

*Primary Examiner*—Donnie L. Crosland
*Attorney, Agent, or Firm*—Baker & Botts, LLP

[57] ABSTRACT

In a method for frequency analysis of a signal of a hazard detector, wavelet transformation is combined with fuzzy logic analysis. In the transformation, based on orthonormal or semi-orthonormal wavelets, an original signal is fed to a multi-stage filter cascade of pairs of high-pass/low-pass filters. From the output of the high-pass filter, wavelet coefficients and values of the original signal, each filter stage produces an association function. The functions are normalized and analyzed further in accordance with fuzzy logic rules. The method is particularly suitable for analyzing signals from flame detectors, noise detectors and the like. As processor code for transformation and analysis is kept short, high speed and accuracy are achieved at low cost.

7 Claims, 4 Drawing Sheets

METHOD FOR ANALYZING THE SIGNALS OF A DANGER ALARM SYSTEM AND DANGER ALARM SYSTEM FOR IMPLEMENTING SAID METHOD

BACKGROUND OF THE INVENTION

The present invention relates to a method of analyzing the signal of a hazard detector by frequency analysis and fuzzy logic analysis and to a hazard detector for the implementation of this method. The hazard detector can for example be a flame detector, noise detector, fire detector, passive infrared detector or the like.

The output signals of hazard detectors are often characterised by typical frequency spectra. By analyzing these frequency spectra it is possible to determine the origin of the signals and in particular genuine alarm signals can be differentiated from interference signals and false alarms thus avoided. In particular in the case of flame detectors, the typical low-frequency flickering of a flame is analyzed in order to be able to distinguish the radiation of genuine flames from those of an interference source, such as for example reflected sunlight, or a flickering light source.

The output signals of hazard detectors are analyzed for example by Fourier analysis, fast Fourier analysis, the zero crossing method or the turning point method. The latter is described in GB-A 2 277 989 in the example of flame detectors where the time intervals between radiation maxima are measured and checked in respect of their regularities and irregularities, irregularly occurring radiation maxima being interpreted as a flame and regularly occurring radiation maxima as an interference.

Fuzzy logic is generally known. In the context of the present invention it is to be emphasised that signal values are assigned to so-called fuzzy sets or indeterminate quantities in accordance with an association function, the value of the association function or the degree of the association with an indeterminate quantity amounting to between zero and one. Here it is important that the association function should be able to be normalised, i.e. the sum of all the values of the association function should be one, whereby the fuzzy logic analysis permits a clearly defined interpretation of the signal.

In a flame detector described in EP-A 0 718 814, the frequency of the detected radiation is analyzed, differentiating between regular and irregular signals in specified frequency ranges. The analysis of the various signals in the given frequency ranges takes place in accordance with a plurality of fuzzy logic rules. This method permits a more precise differentiation between genuine flame signals and other interference signals and thus safeguards against false alarms. Here the frequency spectrum is generated for example by fast Fourier transformation, which is costly in terms of the time required for the transformation, the required processor and the processor costs. In part, up to three seconds are required for the determination of a detected signal. However, for specific applications a shorter analysis time and reaction time leading up to the alarm is desirable; in such cases although methods such as the zero crossing method or turning point method or wavelet analysis method speed up the decision process, they are less accurate.

SUMMARY OF THE INVENTION

The object of the invention is to provide a method for the frequency-analysis of a signal of a hazard detector which is combined with fuzzy logic analysis and compared to analysis methods of the prior art is performed with a smaller number of calculation steps so that a result of the same or improved accuracy is obtained in a shorter time.

Furthermore, the method is to be able to be carried out using a simpler processor and thus more cost-effectively.

This object is achieved in accordance with the invention in that a fast wavelet transformation is performed by way of frequency analysis, the original signal being conducted through a multi-stage filter cascade of pairs of high/low-pass filters, and that in each filter stage of the wavelet transformation, from the results of the high-pass filter an association function is in each case produced, which association function is used for the further analysis of the frequency signal in accordance with fuzzy logic rules.

Wavelet transformation is a transformation or imaging of a signal from the time domain into the frequency domain (see for example "The Fast Wavelet Transform" by Mac A. Cody in Dr. Dobb's Journal, April 1992); thus it is fundamentally similar to Fourier transformation and fast Fourier transformation. However it differs from these methods by virtue of the basic function of the transformation in accordance with which the signal is developed. In Fourier transformation a sine- and cosine-function is used which is sharply localised in the frequency domain and is undefined in the time domain. In the case of wavelet transformation a so-called wavelet or wave packet is used. Of these, many types exist, such as for example a Gaussian-, spline or hair wavelet which, in each case by means of two parameters, can be arbitrarily displaced in the time domain and expanded or compressed in the frequency domain.

Signals localised both in the time domain and in the frequency domain can thus be transformed by wavelet transformation. Fast wavelet transformation is carried out in accordance with the Mallat pyramid algorithm which is based on the repeated use of a low-pass- and high-pass filter by which the low-frequency signal components are separated from the high-frequency signal components. Here the output signal of the low-pass filter is again in each case fed to a pair of low-pass/high-pass filters. This results in a series of approximations of the original signal, each of which has a coarser resolution than the previous. The number of operations required for the transformation is in each case proportional to the length of the original signal, whereas in the case of Fourier transformation this number is superproportional to the signal length. Fast wavelet transformation can also be performed in inverse manner in that the original signal is restored from the approximated values and coefficients for the reconstruction. The algorithm for the analysis and reconstruction of the signal and a table of the coefficients of the analysis and reconstruction are given in the example of a spline wavelet in "An Introduction to Wavelets" by Charles K. Chui (Academic Press, San Diego, 1992).

In the example of a hazard detector, the results of the fuzzy analysis permit a decision as to whether an alarm signal or an interference signal is present. The number of calculation steps required for the wavelet analysis is significantly reduced compared to Fourier analyses. Consequently the computing time required to identify the signal is shortened and the processor costs are reduced.

In accordance with the invention, the original digitalized signal is firstly analyzed by fast wavelet transformation. For this purpose, in accordance with the Mallat algorithm the signal is conducted through a plurality of stages of a cascade of pairs of high-pass and low-pass filters. Then, from the results of the high-pass filters, in each filter stage an association function is generated which contains the sum of the calculated values from the high-pass filter and is divided by the sum of the squares of the original signal values. The sum of the association functions, which here is formed in the case of each filter stage, is equal or virtually equal to one. These normalised association functions are then used in this form for the continuation of the fuzzy logic frequency analysis.

A frequency analysis of this type results in the following advantages: the high-pass filters of the wavelet transformation firstly provide information relating to the high-frequency signals. This is particularly advantageous in the case of flame detection as the information relating to the higher frequencies enables the identification of the type of signal to be speeded up and the accuracy of the identification to be improved. If for example a high-frequency signal exceeding 15 Hz is discovered, this is interpreted as an interference signal. The following report, interference signal or alarm signal, is obtained earlier and is correct to a greater degree of certainty. Wavelets are often very simple in their form, such as for example a hair wavelet, and permit analysis in a small number of calculation steps, which additionally reduces the calculation time and decision time. However, the reduction in the decision time does not involve a loss of accuracy in the signal identification. If fewer lines of code are required, it is also possible to use a more cost-effective processor.

A first preferred embodiment of the method according to the invention is characterised in that the wavelet used for the fast wavelet transformation is an orthonormal or semi-orthonormal wavelet or also a wavelet packet base, and that the generated association functions in each case contain the sum, weighted by the wavelet coefficients, of the squared values of the high-pass filter and the sum of the squared values of the original signal and are used in normalised form for the further analysis of the frequency signal in accordance with fuzzy logic rules.

In a second preferred embodiment, the wavelet used for the fast wavelet transformation is an orthonormal or semi-orthonormal wavelet or a wavelet packet base and the generated association functions in each case contain the sum of the squared output values of the high-pass filter and the sum of the squared values of the original signal of the hazard detector and are used in normalised form for the analysis of the frequency signal in accordance with fuzzy logic rules.

The hazard detector according to the invention for the implementation of the aforesaid method comprises a sensor for a hazard characteristic variable, an analysis electronics unit with means for processing the output signal of the sensor and a microprocessor with a fuzzy controller. This hazard detector is characterised in that the microprocessor has a software program in accordance with which the fuzzy controller is part of a fuzzy wavelet controller, and that the signal processed by the analysis electronics unit and fed to the fuzzy controller is wavelet-transformed.

BRIEF DESCRIPTION OF THE DRAWING

In the following the invention will be explained in detail in the form of an exemplary embodiment illustrated in the drawing in which.

DETAILED DESCRIPTION

Figure 1:
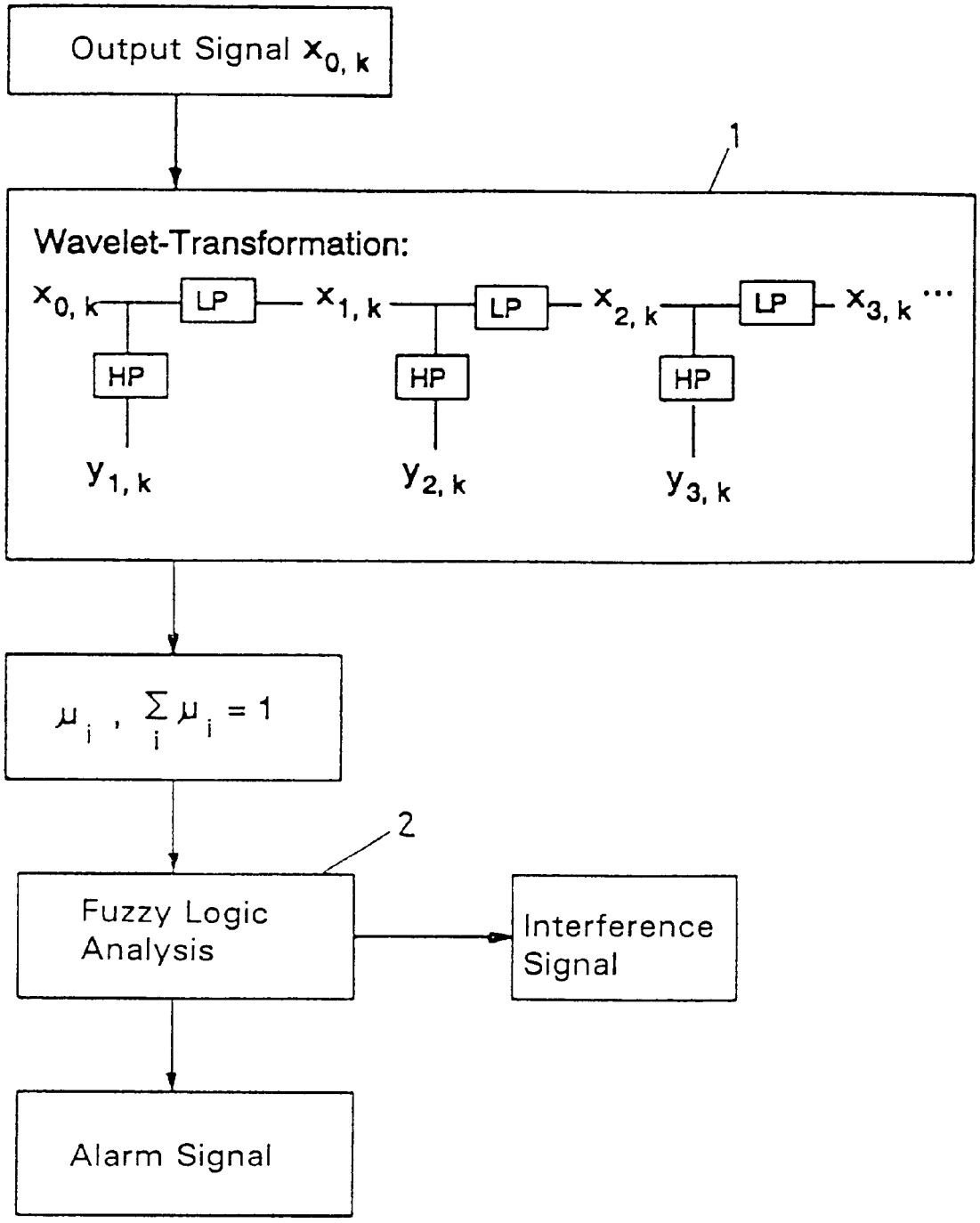
FIG. 1 is a block diagram of a method employing fast wavelet analysis by a plurality of filter stages and fuzzy logic further analysis.

In accordance with FIG. 1, with the output signal $x_{0,k}$, firstly a fast wavelet transformation 1 is performed by means of an arbitrary wavelet of the type known from the prior art. Preferably an orthonormal or semi-orthonormal wavelet or a wavelet-packet base is used. In the Figure the signal values have been referenced $x_{i,k}$ and $y_{i,k}$, where x signifies the original signal values and the values from the low-pass filters (LP) and y signifies the values from the high-pass filters (HP). The index i designates, in ascending order, the stage of the filter cascade, the original signal being at stage zero. The index k designates an individual value of a signal. An original signal $x_{0,k}$ at stage zero is taken as starting point, which signal is transformed by a plurality of filter processes. The output signal of the first high-pass filter results in the values $y_{1,k}$ and the output signal of the first low-pass filter, which at the same time forms the input signal for the second filter stage, results in the values $x_{1,k}$. The output signal of the second high-pass filter results in the values $y_{2,k}$, the output signal of the second low-pass filter, $x_{2,k}$, is fed to a third pair of filters etc. Here it should be noted that the number of values resulting from the filter stages is different in each stage. To be more precise, in each stage the number of values is reduced by the factor two. In the case of stage i+1 for example the output values of a high-pass filter are expressed by $$y_{i+l,k} = \sum_l a_{1-2k} x_{i,l}$$

and the output values of a low pass-filter are expressed by $$x_{i+l,k} = \sum_l b_{1-2k} x_{i,l}.$$

The coefficients a and b for the transformation are generally known and can be calculated with the aid of the aforementioned book by Chui. For example for a hair wavelet $a_0=a_1=½$, $b_0=½$ and $b_1=-½$. The index 1 in each case assumes whole-numbered values for which the coefficients are unequal to zero. The reconstruction of the original signal takes place in stages in that the values of each filter stage are created for the values of the previous stage, namely $$x_{i,k} = \sum_l (p_{k-2l} x_{i+l,1} + q_{k-2l}, y_{i+l,1}).$$

The coefficients p and q for the wavelet reconstruction are given in the aforementioned book.

Then the association functions $\mu_i$ are produced from the output values of the high-pass filter of the respective filter stage and the associated coefficients q for the wavelet reconstruction.

Here $$\mu_i = \frac{\sum_l (q_{k-2l} y_{i,l})^2}{\sum_{l'} (x_{0,l'})^2} \quad \text{for } i = 1, 2, \ldots, N \qquad \text{(Equation 1)}$$

and $$\mu_{N+1} = \frac{\sum_{l} (p_{k-2l} x_{N,l})^2}{\sum_{l'} (x_{0,l'})^2} \quad \text{for } i = N+1 \text{ where } N \text{ is the number of filter stages.}$$

The latter function $\mu_{N+1}$ is thus formed by the output values of the last low-pass filter. These association functions are normalised in that $$\sum_{l'} \mu_i = 1.$$

An often good approximation of these association functions is given by the following equation:

$$\mu_i = \frac{\sum_{l} (y_{i,l})^2}{\sum_{l'} (x_{0,l'})^2} \quad \text{for } i = 1, 2, \ldots, N \text{ and}$$

$$\mu_{N+1} = \frac{\sum_{l} (x_{N,l})^2}{\sum_{l'} (x_{0,l'})^2} \quad \text{for } i = N+1$$

In this approximation the function is virtually normalised in that $$\sum_{l} \mu_i \approx 1.$$

In a special embodiment of the method the digitalized non-linearised values $x_{0,k}$ are subjected to fast hair analysis. From the values $y_{i,k}$ of each filter stage i, association functions $\mu_i$ are formed, namely:

$$\mu_i = \frac{\sum_{l} (y_{i,l})^2}{\sum_{l'} (x_{0,l'})^2} \quad \text{for } i = 1, 2, \ldots, N \text{ and}$$

$$\mu_{N+1} = \frac{\sum_{l} (x_{N,l})^2}{\sum_{l'} (x_{0,l'})^2} \quad \text{for } i = N+1 \cdot$$

These association functions are in this case normalised in that $$\sum_{l} \mu_i = 1.$$

Figure 2:
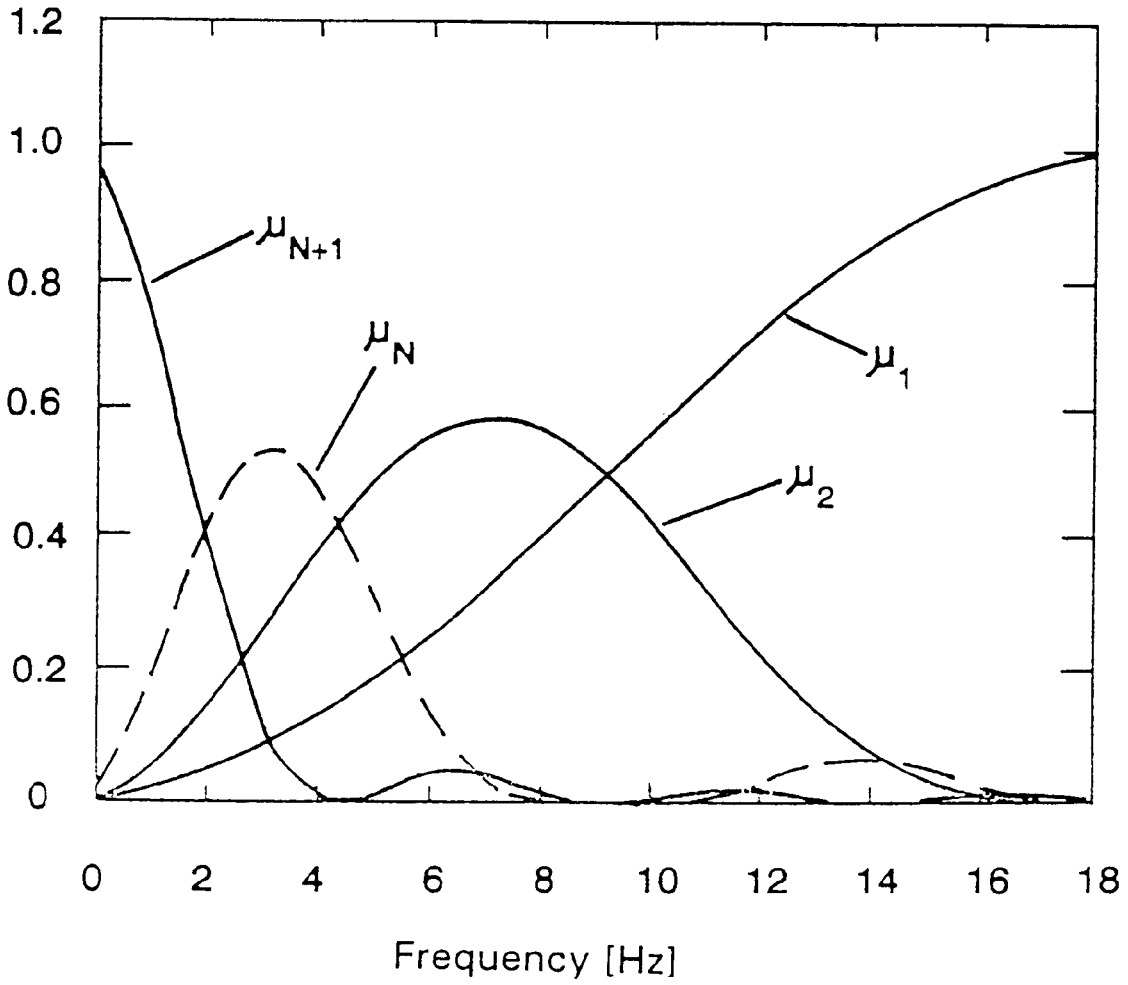
FIG. 2 illustrates association functions in the case of frequency analysis by fast hair wavelet transformation.

In FIG. 2 association functions $\mu$ which have been produced from the results of a fast hair wavelet transformation are shown as a function of the frequency. Of the various curves, $\mu_{N+1}$ illustrates the degree of association of very low frequencies, $\mu_N$ illustrates the degree of association of low frequencies and $\mu_1$ and $\mu_2$ illustrate the degree of association of high and middle frequencies respectively. It will be clear that at each selected frequency the sum of the curve values amounts to one.

In all the embodiments of the method these association functions are fed to a fuzzy logic controller 2 (FIG. 1) for analysis in accordance with fuzzy logic rules, whereupon a decision is made as to whether an alarm signal is triggered or the signal is evaluated as an interference.

In the case of flame detectors, this method is suitable for differentiating between interference signals, such as for example periodic signals exceeding 15 Hz and genuine flame signals, such as for example narrow-band signals of low frequency or wide-band signals in the low frequency range. As a result of the rapid identification of high-frequency signals, the interference signals of this frequency and their resonance frequencies are eliminated from the signal, which speeds up the frequency analysis of the signal. Due to the speeding up of the frequency analysis by the wavelet transformation, the time required for deciding upon the type of the signal and the report to be given can be reduced from for example previously three seconds to one second. The described method is also suitable for noise detectors, passive infrared detectors, the spectral analysis of the signals of individual pixels in image processing and for different sensors, such as gas- and vibration sensors.

Figure 3:
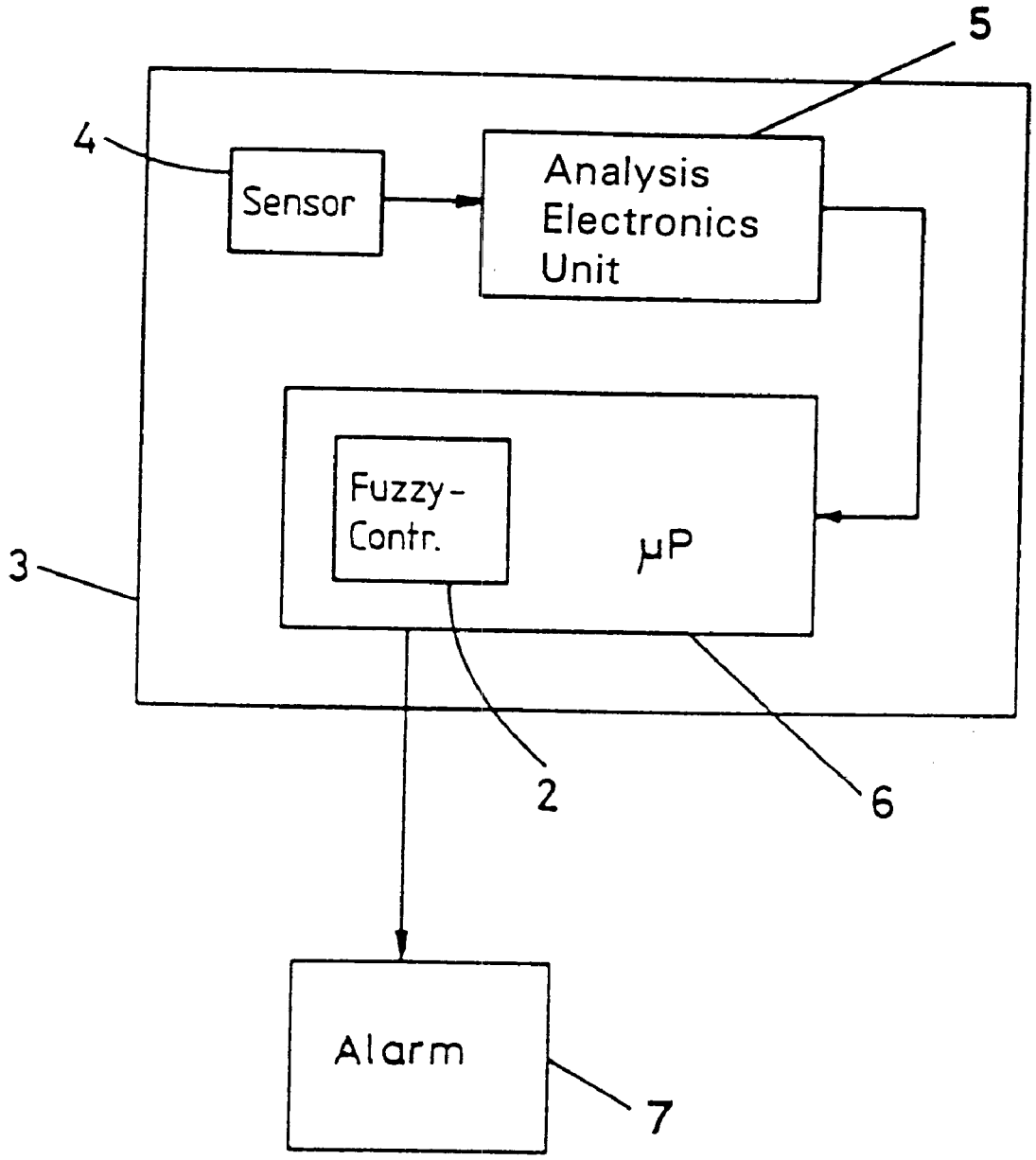
FIG. 3 is a block diagram of a hazard detector for the implementation of the method according to FIG. 1

FIG. 3 is a diagram of a hazard detector 3 for the implementation of the described method. In accordance with the drawing, the hazard detector 3 comprises a sensor 4 for detecting a hazard characteristic variable, an analysis electronics unit 5, a microprocessor 6 and the fuzzy controller 2. The hazard characteristic variable can for example be the intensity of the radiation emitted from a flame, the acoustic signal of a noise, the infrared radiation emitted by a warm body or the output signal of a CCD camera.

The output signal of the sensor 4 is fed to the analysis electronics unit 5 which comprises suitable means for the processing of the signal, such as for example amplifiers, and is fed from the analysis electronics unit 5 into the microprocessor 6. The fuzzy controller 2 (FIG. 1) here is integrated into the microprocessor 6 in the form of software. In particular the fuzzy controller is part of a fuzzy wavelet controller which links the fuzzy logic theory with the wavelet theory. The microprocessor 6 contains for example a software program of the type shown in FIG. 4 which subjects the input signal to wavelet transformation. The resultant, transformed signal is then fed to the fuzzy controller 2. If the signal resulting from the fuzzy controller 2 is evaluated as an alarm, the latter is fed to an alarm output device 7 or an alarm control centre.

Figure 4:
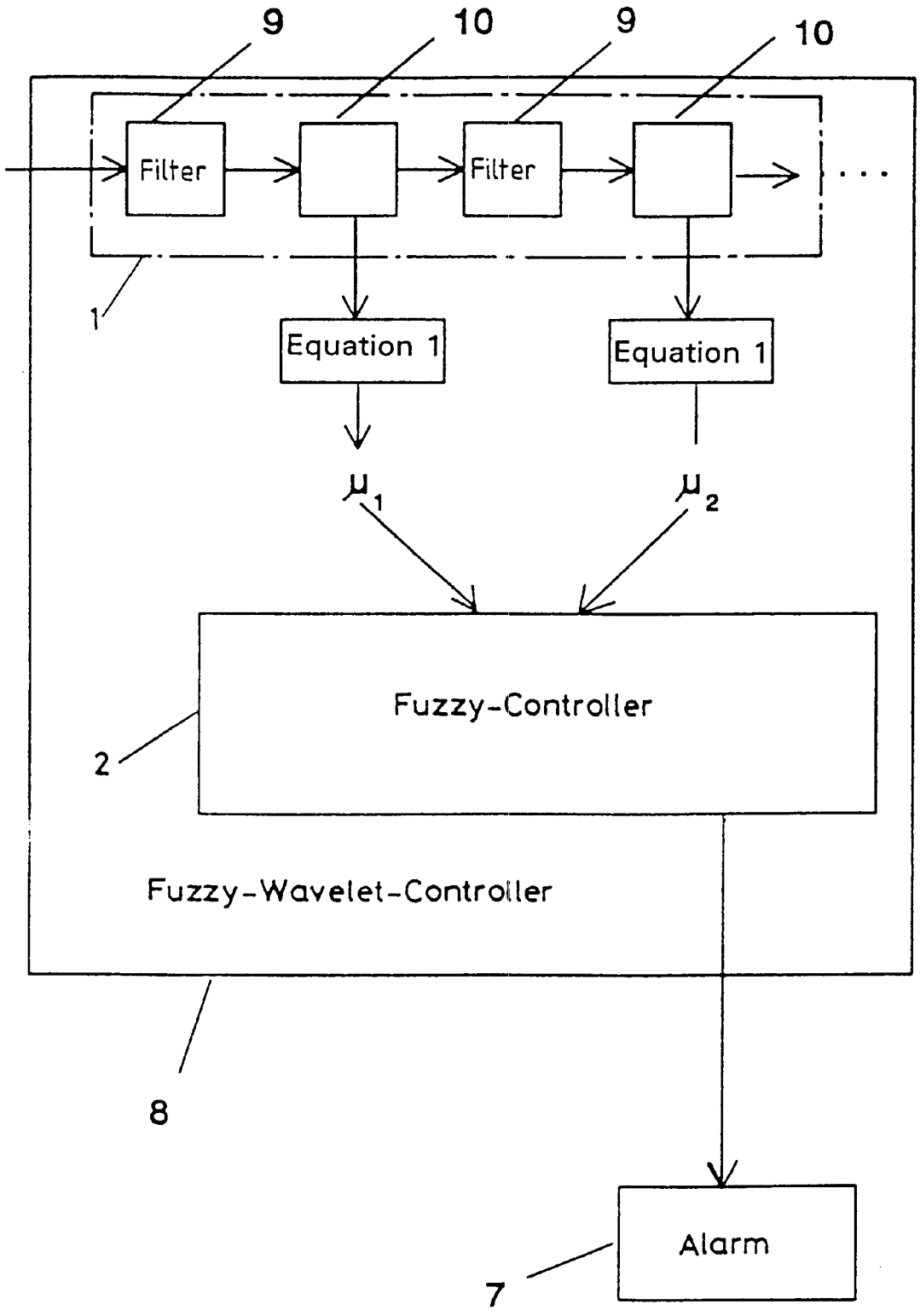
FIG. 4 is a block diagram of the implementation of the method according to FIG. 1 in a hazard detector.

FIG. 4 is a block diagram for the implementation of the method according to the invention in the microprocessor of a hazard detector, said microprocessor comprising a fuzzy wavelet controller 8. Following analysis by the analysis electronics unit 5 (FIG. 3) the output signal of the sensor 4 is fed to the fuzzy wavelet controller 8 in which the signal is firstly fed through a cascade of filters 9. From the results 10 of each filter 9, the association functions $\mu_i$ are formed in accordance with Equation 1. These functions are then fed for fuzzy analysis to the fuzzy controller 2 which optionally transmits a signal to the alarm output device 7.

I claim:

1. A method for analyzing a hazard detector signal, comprising the steps of:

multi-stage filtering for fast wavelet transformation of the signal, utilizing a cascade of filter stages wherein each stage comprises a high-pass and a low-pass filter such that the high-pass filter of each filter stage generates an association function; and analyzing the association functions in accordance with fuzzy logic rules.

2. The method of claim 1, wherein the fast wavelet transformation is based on wavelets which are selected from the group consisting of orthonormal wavelets, semi-orthonormal wavelets and a wavelet packet base, and wherein generating the association functions comprises the steps of:

summing squares of weighted output values from each high-pass filter to obtain respective first sums; and normalizing by dividing each of the first sums by a second sum, of squares of values of the hazard detector signal.

3. The method of claim 1, wherein the fast wavelet transformation is based on wavelets which are selected from the group consisting of orthonormal wavelets, semi-orthonormal wavelets and a wavelet packet base, and wherein generating the association functions comprises the steps of:

summing squares of output values from each high-pass filter to obtain respective first sums; and normalizing by dividing each of the first sums by a second sum, of squares of values of the hazard detector signal.

4. The method of claim 1, 2 or 3, wherein the hazard detector signal is from a flame detector, and wherein the steps of filtering and analyzing combined are effected within a time span in a range from 100 ms to 10 s.

5. A hazard detector comprising:

a sensor for a hazard characteristic variable;

an analyzer electronics unit operationally coupled to the sensor for receiving values of the hazard characteristic variable and comprising a cascade of filter stages wherein each stage comprises a high-pass and a low-pass filter, for the high-pass filter of each filter stage to generate a fast wavelet transformation association function, and further comprising processor means which is programmed for analyzing the association functions in accordance with fuzzy logic rules.

6. The hazard detector of claim 5, wherein the association functions are based on wavelets which are selected from the group consisting of orthonormal wavelets, semi-orthonormal wavelets and a wavelet packet base, and wherein, for generating the association functions, the programming is for:

summing squares of weighted output values from each high-pass filter to obtain respective first sums; and normalizing by dividing each of the first sums by a second sum, of squares of values of the hazard detector signal.

7. The hazard detector of claim 5, wherein the association functions are based on wavelets which are selected from the group consisting of orthonormal wavelets, semi-orthonormal wavelets and a wavelet packet base, and wherein, for generating the association functions, the programming is for:

summing squares of output values from each high-pass filter to obtain respective first sums; and normalizing by dividing each of the first sums by a second sum, of squares of values of the hazard detector signal.

* * * * *